US008550039B2

(12) United States Patent
Hineiti et al.

(10) Patent No.: US 8,550,039 B2
(45) Date of Patent: Oct. 8, 2013

(54) PUMP ASSEMBLY AND METHOD OF MANUFACTURING SAME

(75) Inventors: Naser I. Hineiti, Novi, MI (US); Dan L. Alden, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 293 days.

(21) Appl. No.: 12/913,894

(22) Filed: Oct. 28, 2010

(65) Prior Publication Data

US 2012/0103285 A1 May 3, 2012

(51) Int. Cl.
*F01P 5/10* (2006.01)

(52) U.S. Cl.
USPC ..... 123/41.44; 123/41.46; 123/41.49; 415/206; 415/203; 29/888.024; 29/889.6; 29/889.61

(58) Field of Classification Search
USPC ..... 123/41.44, 41.01, 41.11, 41.46, 41.49, 123/41.58, 41.65, 41.63; 415/206, 203, 415/185, 168.2, 230, 111, 169.1; 29/889, 29/889.21, 889.23, 889.3, 889.4, 889.5, 29/889.6, 889.61, 889.721
See application file for complete search history.

(56) References Cited

U.S. PATENT DOCUMENTS 2,206,488 A * 7/1940 Pavlecka et al. ..... 415/140
3,162,136 A * 12/1964 Clary et al. ..... 415/203
3,220,461 A * 11/1965 Richardson ..... 431/78
4,832,573 A 5/1989 Dorski
5,131,809 A * 7/1992 Gesenhues et al. ..... 415/168.2
5,224,823 A * 7/1993 Cordts ..... 415/206
5,242,268 A 9/1993 Fukazawa et al.
6,143,039 A * 11/2000 Pedemonte et al. ..... 8/549
6,289,854 B1 * 9/2001 Holmstrom et al. ..... 123/41.44
6,413,039 B1 * 7/2002 Morris et al. ..... 415/111
6,419,450 B1 * 7/2002 Lum ..... 416/186 A
7,114,926 B2 10/2006 Oshita et al.
7,264,443 B2 9/2007 Rozario et al.
2008/0317609 A1 * 12/2008 Schmidt et al. ..... 417/307

OTHER PUBLICATIONS

Pending U.S. Appl. No. 12/545,898, filed Aug. 24, 2009, Centrifugal Fluid Pump, Akram R. Zahdeh.

* cited by examiner

*Primary Examiner* — Noah Kamen
*Assistant Examiner* — Long T Tran
(74) *Attorney, Agent, or Firm* — Quinn Law Group, PLLC

(57) ABSTRACT

A method of manufacturing a pump assembly includes sand casting a pump housing with a cavity and die casting an impeller that includes pump blades and a first portion of a shroud. The pump housing may be sand cast as a one-piece component and the impeller may be die cast as another one-piece component. A pump cover is provided with a second portion of the shroud. The pump cover is inserted into the cavity so that the second portion of the shroud is adjacent to the first portion of the shroud, providing a substantially continuous surface defining flow channels through the impeller. A pump assembly manufactured according to the method is also provided.

15 Claims, 3 Drawing Sheets

PUMP ASSEMBLY AND METHOD OF MANUFACTURING SAME

TECHNICAL FIELD

The invention relates to a pump assembly and a method of manufacturing a pump assembly.

BACKGROUND

Shaft driven centrifugal vane pumps are often used for cooling of automotive engines. Water or other fluid is directed axially into the pump and exits radially into one or more volutes. The shaft is typically mechanically driven, directly or indirectly by the engine crankshaft, and therefore rotates at some speed proportional to engine speed. Pump design affects pump efficiency. An increase in pump efficiency means less power is consumed in driving the pump, and can result in improved fuel economy. Less than ideal fluid flow results in flow separation in the flow field, which reduces pump capacity and may cause unwanted pump noise due to cavitation. Cavitation occurs when local boiling of the fluid occurs due to low pressure conditions in the separation zones of the flow. As a result, vapor bubbles are created in the flow. The bubbles collapse or implode as the flow passes from a relatively low pressure region of a pump, such as a fluid inlet, to a relatively higher pressure region, such as a discharge or outlet region.

Certain impeller designs may be configured to reduce cavitation and increase pump efficiency. The geometric configuration of the impeller, including the design of the pump vanes or blades, and the shroud, may necessitate sand casting of the impeller rather than the less expensive stamping of die casting.

SUMMARY

A pump assembly and a method of manufacturing a pump assembly utilize a "split-shroud" design in order to allow the impeller to be die cast while still providing desired shroud and impeller shapes that affect flow through the pump assembly. The method includes sand casting a pump housing with a cavity and die casting an impeller that includes pump blades and a first portion of a shroud. The pump housing may be sand cast as a one-piece component and the impeller may be die cast as another one-piece component. A pump cover is provided with a second portion of the shroud. The pump cover is inserted into the cavity so that the second portion of the shroud is adjacent to the first portion of the shroud, providing a substantially continuous surface that partially defines flow channels through the impeller. The split portions of the shroud are thus arranged to define a substantially contiguous shroud in the completed pump assembly, allowing the impeller to be die cast while still providing the pumping efficiency benefits afforded by the design of the entire shroud.

A pump assembly is thus provided that has a pump housing defining a cavity. An impeller is inserted into the cavity. The impeller has blades and a first portion of a shroud integrally formed with the blades. The blades and the first portion of the shroud partially establish a plurality of flow chambers. An annular pump cover is fit to the pump housing at the cavity. The pump cover defines a second portion of the shroud further establishing the plurality of flow chambers. The pump assembly may included in an engine assembly, and may form a portion of a cooling circuit for the engine assembly.

By splitting the shroud into two separate components, the impeller can be die cast to achieve with the pump cover the overall flow design that will increase pump efficiency relative to a stamped impeller, thus leading to better fuel economy. Die casting the impeller is less expensive than the sand casting process that would be necessary if the shroud was not split. The assembly is relatively easy to assemble, and provides robust sealing and component design, further increasing pump efficiency.

The above features and advantages and other features and advantages of the present invention are readily apparent from the following detailed description of the best modes for carrying out the invention when taken in connection with the accompanying drawings.

DETAILED DESCRIPTION

Figure 1:
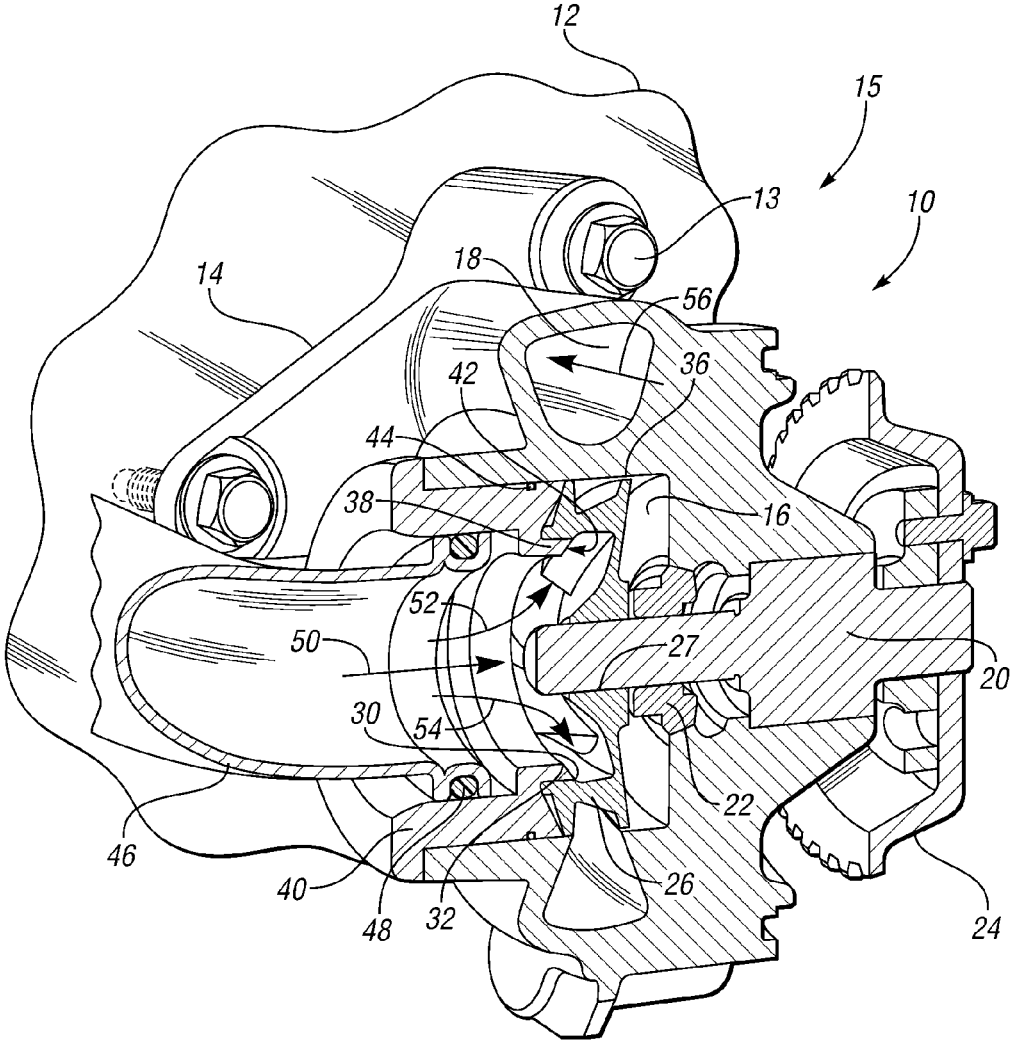
FIG. 1 is a schematic cross-sectional perspective illustration in partial fragmentary view of a water pump assembly bolted to an engine block.

Referring to the drawings, wherein like reference numbers refer to like components, FIG. 1 shows a pump assembly 10 mounted to an engine block 12 with bolts 13 (only one bolt 13 numbered in FIG. 1). The pump assembly 10 and engine block 12 are part of an engine assembly 15, such as an automotive engine assembly. The pump assembly 10 is a shaft driven, centrifugal automotive water pump, but the invention as claimed is not limited to such. The pump assembly 10 is of an efficient design and is manufactured according to a cost effective method 100, described below.

FIG. 1 shows the pump assembly 10 including a pump housing 14. The pump housing 14 is a one-piece component that is sand cast to define a cavity 16 and volutes 18. The pump assembly 10 includes a rotatable shaft 20 that is inserted into one end of the cavity 16. A seal 22 prevents fluid from passing out of the cavity 16 past the shaft 20. The shaft 20 is connected for rotation with a sprocket 24 that is driven off of an engine crankshaft of the engine assembly 15 by a chain (not shown). Alternative means of driving the shaft 20, such as a gear arrangement, may also be used.

Figure 2:
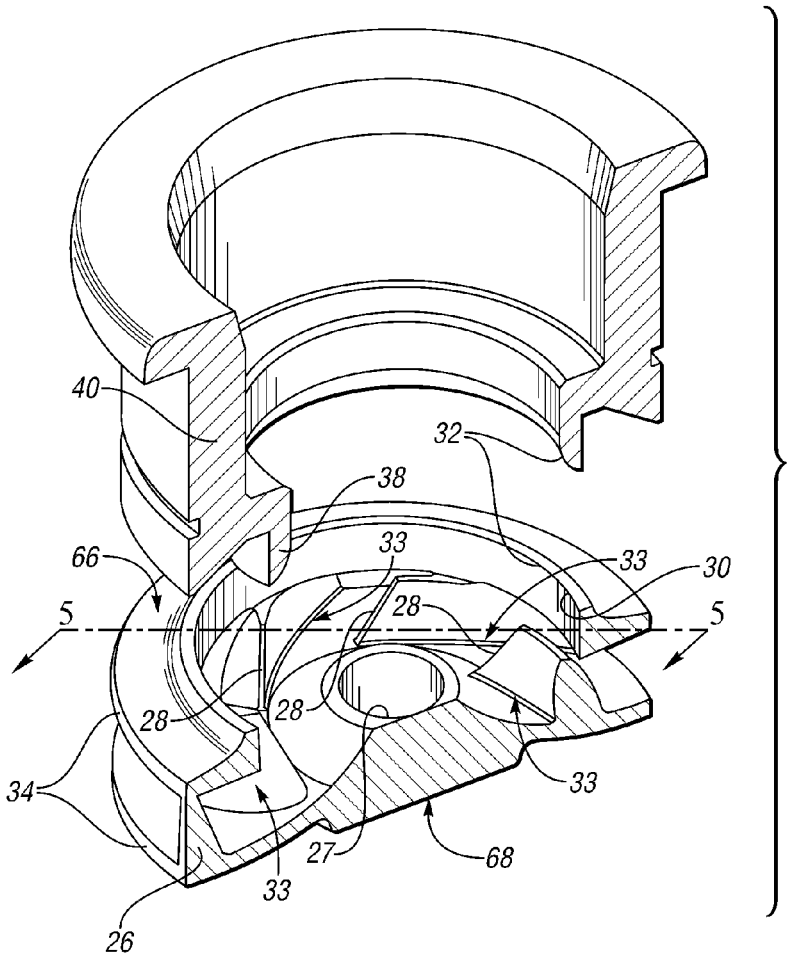
FIG. 2 is a schematic cross-sectional perspective illustration in exploded view of an impeller and pump cover of the water pump assembly of FIG. 1.

A one-piece, die cast impeller 26 is inserted into the cavity 16 such that the shaft 20 extends through an aperture 27 of the impeller 26, and the impeller 26 is fit onto the shaft 20 for rotation with the shaft 20. The impeller 26 is best shown in FIG. 2, and includes integral blades 28 and a first portion 30 of a shroud 32. The blades 28 and the first portion 30 of the shroud 32 partially define flow chambers 33. An outer periphery 34 of the impeller 26 is machined so that the impeller 26 defines a predetermined clearance 36 with the pump housing 14 when inserted into the cavity 16, as shown in FIG. 1. For increased pump efficiency, it is desirable that each of the flow chambers 33 has a constant cross-sectional area generally perpendicular to the direction of fluid flow through the chamber 33. Providing flow chambers 33 with such a configuration requires that the shroud 32 extend further than can be formed by die casting, as die casting the entire shroud 32 with the impeller 26 would cause die lock.

Figure 5:
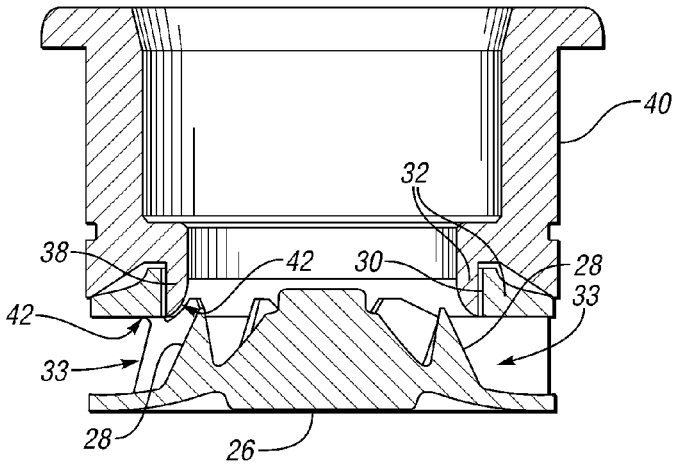
FIG. 5 is a schematic cross-sectional illustration of the impeller and pump cover of FIG. 2 assembled to one another and taken at the lines 5-5 in FIG. 2.

Referring to FIG. 2, to provide the desired configuration of the impeller 26, a second portion 38 of the shroud 32 is made integral with a separate component, an annular pump cover 40 that is inserted in to the cavity 16 of FIG. 1 so that the second portion 38 of the shroud 32 is adjacent the first portion 30 of the shroud 32. In fact, the first portion 30 and the second portion 38 define a continuous surface 42 (indicated in FIGS. 1 and 5) that further defines the flow chambers 33 with constant cross-sectional area perpendicular to fluid flow. The pump cover 40 may be machined, forged, or otherwise formed. The pump cover 40 is sized to be press-fit into the cavity 16. A seal 44 between the pump cover 40 and the pump housing 14 prevents leakage past the pump cover 40.

A coolant circuit for the engine assembly 15 is partially defined by a fluid feed tube 46 that is inserted into the pump cover 40 and fit to the pump cover 40 with a seal 48 to prevent leakage from the pump assembly 10. Fluid, which in this case is water, is fed into the pump through the feed tube 46 in the direction of arrow 50. Fluid then flows in the direction of arrows 52, 54, through the various flow channels 33 (flow into only two of the flow channels 33 of FIG. 2 indicated by arrows 52, 54, but fluid flow occurs in similar directions through the additional flow channels 33). The shroud 32 formed by the first portion 30 and the second portion 38 in part creates the constant cross-sectional area of the flow chambers 33. Fluid exits the pump housing 14 through the various volutes 18 in the direction of arrow 56 into the engine block 12 through an opening in the block 12 (not shown) that is in communication with the volutes 18. The pump assembly 10 further defines the coolant circuit for the engine assembly 10, as it directs fluid into the engine block 12.

Figure 3:
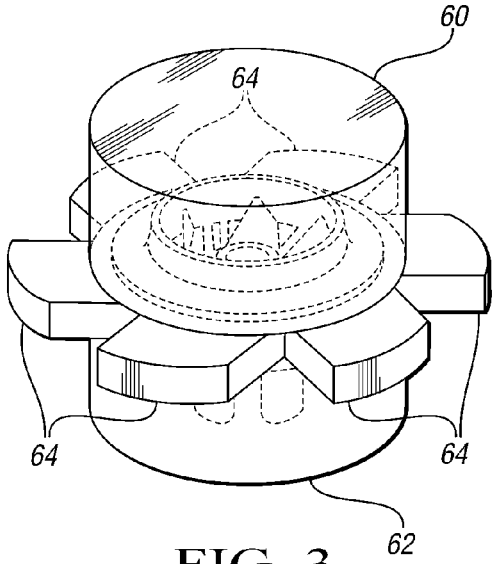
FIG. 3 is a schematic perspective view of dies and inserts used to cast the impeller of FIGS. 1 and 2.

Referring to FIG. 3, a first die 60, a second die 62, and a plurality of tools 64 that may be referred to as slides 64 are shown positioned to die cast the impeller 26 of FIG. 2. The first die 60 and the second die 62 are arranged opposite from one another and are configured to form opposing surfaces of the impeller 26. That is, the first die 60 forms a first surface 66 (see FIG. 2), referred to as an upper surface, of the impeller 26, as well as a portion of the flow areas 33 and a portion of the blades 28 formable by moving first die in an axial direction only (i.e., straight up in FIG. 5). The second die 62 forms a second surface 68 (see FIG. 2), referred to as a bottom surface, of the impeller 26. The tools 64 are arranged generally perpendicular to the dies 60, 62 and extend inward to partially define the blades 28 and partially define the flow channels 33 of FIG. 2.

Figure 4:
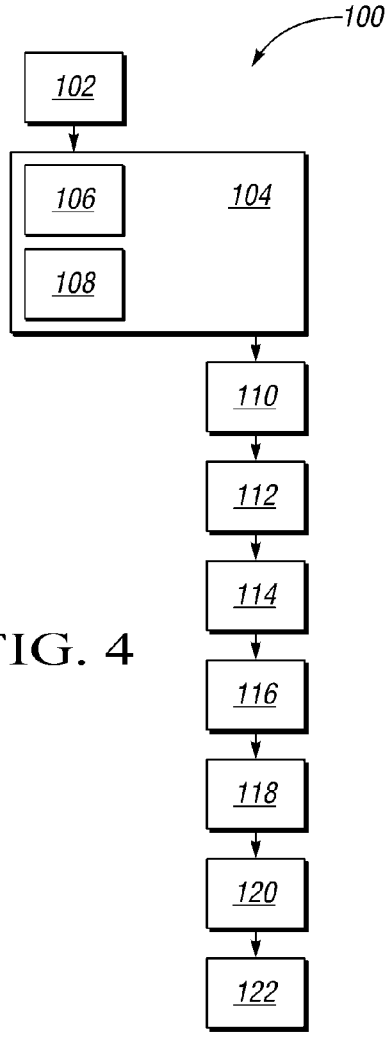
FIG. 4 is a flow diagram of a method of manufacturing the water pump assembly of FIG. 1.

Referring to FIG. 4, a method 100 of manufacturing the pump assembly 10 of FIG. 1 is illustrated as a flow diagram. Although described with respect to the pump assembly 10, the method 100 may be used to manufacture other pump assemblies. The method 100 need not be performed in the order shown in the flow diagram. The method 100 includes block 102, sand casting a pump housing 14 with a cavity 16. The pump housing 14 is configured so that it may be sand cast as a one-piece component, helping to minimize leakage that may occur if multiple pieces are secured to one another to form a multi-piece pump housing.

In block 104, the impeller 26 is die cast. Die casting may be more economical than sand casting. By splitting the shroud 32 into two shroud portions, first portion 30 and second portion 38, the desired shroud profile provided by surface 42 (best shown in FIG. 5) is provided without die lock up as would occur if the entire shroud 32 were integral with the impeller 26. Block 104 includes sub-blocks 106 and 108. In block 106, the dies 60, 62 of FIG. 3 are arranged. In block 108, the tools 64 are extended to define the blades 28 and flow chambers 33 of the impeller 26 shown in FIG. 2.

In block 110, after the impeller 26 is die cast, the outer periphery 34 shown in FIG. 2 is machined. In block 112, the rotatable shaft 20 of FIG. 1 is inserted into the cavity 16. In block 114, the impeller 26 is then inserted into the cavity 16 onto the shaft 20. The machined outer periphery 34 defines the predetermined clearance 36 with the pump housing 14.

In block 116, the pump cover 40 is machined, formed, or otherwise provided with dimensions so that it can be inserted to press-fit into the cavity 16 in block 118. When the pump cover 40 is inserted into the cavity 16, the second portion 38 of the shroud 32 is adjacent the first portion 30 of the shroud 32 to define the substantially continuous surface 42 that enables the flow channels 33 to be of a desired shape to increase pumping efficiency of the impeller 26.

In block 120, the pump cover 12 is mounted to the engine block 12 and fastened thereto with bolts 13, or any other type of suitable fastener. The sprocket 24 can then be secured to the shaft 20. In block 122, the feed tube 46 is inserted into the pump cover 40 to allow fluid flow through the pump cover 40 to the impeller 26, and further on to the engine block 12.

While the best modes for carrying out the invention have been described in detail, those familiar with the art to which this invention relates will recognize various alternative designs and embodiments for practicing the invention within the scope of the appended claims.

The invention claimed is:

1. A method of manufacturing a pump assembly comprising:

sand casting a pump housing with a cavity;

die casting an impeller that includes pump blades and a first portion of a shroud that partially establish a plurality of flow chambers;

inserting a pump cover into the cavity; wherein the pump cover defines a second portion of the shroud that is adjacent to and entirely radially inward of the first portion of the shroud when inserted into the cavity and further establishes the plurality of flow chambers; and fastening the pump housing to an engine block such that fluid can flow from the pump cover into the plurality of flow chambers first past the second portion of the shroud and then past the first portion of the shroud to the engine block.

2. The method of claim 1, wherein the pump housing is a one-piece component and the impeller is another one-piece component.

3. The method of claim 1, further comprising:

machining an outer periphery of the impeller; and inserting the impeller into the cavity; wherein the machined outer periphery of the impeller is configured to have a predetermined clearance with the pump housing when inserted into the cavity.

4. The method of claim 3, further comprising inserting a rotatable shaft into the cavity; wherein the impeller is fit onto the rotatable shaft.

5. The method of claim 1, wherein the pump cover is press-fit into the cavity.

6. The method of claim 1, further comprising:

inserting a feed tube into the pump cover for supplying fluid to the impeller and pump housing.

7. The method of claim 1, wherein die-casting the impeller includes:

arranging a first die and a second die opposite from one another; and extending a plurality of tools generally perpendicular to the first and second dies; wherein the first and second dies define opposing surfaces of the impeller, including the first portion of the shroud and the plurality of tools define the flow chambers when the impeller is die cast.

8. A pump assembly comprising:

a pump housing defining a cavity;

an impeller inserted into the cavity; wherein the impeller has blades and a first portion of a shroud integrally formed with the blades; wherein the blades and the first portion of the shroud partially establish a plurality of flow chambers;

an annular pump cover fit to the pump housing at the cavity; wherein the pump cover defines a second portion of the shroud further establishing the plurality of flow chambers; and wherein the first and second portions of the shroud define a substantially continuous surface with the second portion of the shroud entirely radially inward of the first portion of the shroud when the impeller is inserted into the cavity and the annular pump cover is fit to the pump housing so that fluid flows into the plurality of flow chambers first past the second portion of the shroud and then past the first portion of the shroud.

9. The pump assembly of claim 8, further comprising:

a tube fit within the pump cover for supplying fluid to the impeller.

10. The pump assembly of claim 8 in combination with an engine block; wherein the pump housing is configured to be mounted to the engine block so that fluid flows from the pump housing into the engine block.

11. An engine assembly comprising:

an engine block;

a pump assembly operatively connected to the engine block and having a pump housing defining a cavity;

an impeller inserted into the cavity; wherein the impeller has blades and a first portion of a shroud integrally formed with the blades; wherein the blades and the first portion of the shroud partially establish a plurality of flow chambers;

an annular pump cover fit to the pump housing at the cavity; wherein the pump cover defines a second portion of the shroud entirely radially inward of the first portion of the shroud that further establishes the plurality of flow chambers such that fluid flows into the flow chambers first past the second portion of the shroud and then past the first portion of the shroud; and wherein the pump assembly forms a portion of a cooling circuit for the engine assembly and is operable to direct fluid through the cooling circuit.

12. The engine assembly of claim 11, wherein the first and second portions of the shroud define a substantially continuous surface when the impeller is inserted into the cavity and the annular pump cover is fit to the pump housing.

13. The engine assembly of claim 11, further comprising:

a tube fit within the pump cover for supplying fluid to the impeller.

14. The pump assembly of claim 8, wherein the impeller is a one-piece component.

15. The engine assembly of claim 11, wherein the impeller is a one-piece component.

* * * * *